US008217860B2

(12) United States Patent
Mizukoshi et al.

(10) Patent No.: US 8,217,860 B2
(45) Date of Patent: Jul. 10, 2012

(54) METHOD AND DEVICE FOR MEASURING PANEL CURRENT

(75) Inventors: Seiichi Mizukoshi, Kanagawa (JP); Makoto Kohno, Kanagawa (JP); Kouichi Onomura, Yokohama (JP)

(73) Assignee: Global OLED Technology LLC, Herndon, VA (US)

( * ) Notice: Subject to any disclaimer, the term of this patent is extended or adjusted under 35 U.S.C. 154(b) by 1312 days.

(21) Appl. No.: 11/865,843

(22) Filed: Oct. 2, 2007

(65) Prior Publication Data

US 2008/0088567 A1 Apr. 17, 2008

(30) Foreign Application Priority Data

Oct. 13, 2006 (JP) ..... 2006-280280

(51) Int. Cl.
*G09G 3/30* (2006.01)

(52) U.S. Cl. ..... 345/76; 345/45; 345/77; 345/82; 345/204; 345/690; 315/169.1; 315/169.3

(58) Field of Classification Search ..... 345/45, 345/46, 76, 77, 90–92, 204, 82, 83, 690; 315/169.1–169.3
See application file for complete search history.

(56) References Cited

U.S. PATENT DOCUMENTS

| | | | | |
|---|---|---|---|---|
| 6,987,787 | B1 * | 1/2006 | Mick | 372/29.021 |
| 7,274,363 | B2 * | 9/2007 | Ishizuka et al. | 345/211 |
| 7,397,452 | B2 * | 7/2008 | Nakamura | 345/76 |
| 2004/0150592 | A1 | 8/2004 | Mizukoshi et al. | |
| 2004/0263444 | A1 * | 12/2004 | Kimura | 345/82 |
| 2006/0017717 | A1 * | 1/2006 | Tateuchi | 345/204 |
| 2006/0082529 | A1 * | 4/2006 | Oyama | 345/82 |
| 2006/0284802 | A1 * | 12/2006 | Kohno | 345/76 |

FOREIGN PATENT DOCUMENTS

WO 2005/101360 10/2005

* cited by examiner

*Primary Examiner* — Quan-Zhen Wang
*Assistant Examiner* — Jennifer Nguyen
(74) *Attorney, Agent, or Firm* — Morgan, Lewis & Bockius LLP

(57) ABSTRACT

A method of measuring a panel current in an active matrix organic electroluminescence display panel, wherein when a current flowing through a display panel when one or a plurality of pixels are caused to emit light is measured, a flow-in current flowing into the display panel from a side of a high voltage and a flow-out current flowing out from the display panel toward a side of a low voltage are simultaneously measured, and a value of a panel current is determined using both obtained measurement results.

3 Claims, 11 Drawing Sheets

METHOD AND DEVICE FOR MEASURING PANEL CURRENT

CROSS-REFERENCE TO RELATED APPLICATION

This application claims priority of Japanese Patent Application No. 2006-280280 filed Oct. 13, 2006 which is incorporated herein by reference in its entirety.

FIELD OF THE INVENTION

The present invention relates to measurement of a panel current in an active matrix organic electroluminescence (hereinafter referred to as "EL") display panel.

BACKGROUND OF THE INVENTION

FIG. 1 shows a prior art structure of a circuit in a pixel (pixel circuit) in an active matrix organic EL display device.

When a gate line (Gate) extending along the horizontal direction is set at a high level, a selection TFT (thin film transistor) 2 is switched ON. While in this state, a data signal voltage corresponding to the display brightness is applied on a data line (Data) extending along the vertical direction so that the data signal voltage is stored in a storage capacitor C. Because the data signal voltage stored in the storage capacitor is applied to a gate of a driver TFT 1, the driver TFT 1 supplies a drive current corresponding to the data signal voltage to an organic EL element, and light is emitted from the organic EL element. In FIG. 1, PVdd represents a high-voltage side power supply of the panel and CV represents a low-voltage side power supply of the panel.

FIG. 2 shows a prior art structure of a display panel and input signals. As shown in FIG. 2, pixel portions are placed on the display panel in a matrix form. First, a gate driver sets the gate line at the high level and a source driver supplies, on the data line, a data signal voltage for pixels on a horizontal line which is being selected. Then, the gate line is returned to the low level. With this process, the data signal voltage is stored in each pixel portion, and display according to the data signal voltage for the pixel is realized in each pixel until the next frame.

An image data signal, a horizontal synchronization signal, a dot clock, and other drive signals are supplied to the source driver, and the horizontal synchronization signal, a vertical synchronization signal, and other drive signals are supplied to the gate driver.

The amount of light emission from the organic EL element and the drive current are approximately in a proportional relationship. Normally, a voltage (Vth) is applied between the gate of the driver TFT 1 and PVdd so that a drain current starts to flow around a black level of an image. As an amplitude of the data signal voltage, an amplitude is set which causes a predetermined brightness to be achieved near a white level.

FIG. 3 is a prior art diagram showing a relationship between an input signal voltage of the driver TFT 1 (voltage on the data line Data) and current flowing through the organic EL element (CV current). As described above, the CV current corresponds to the emission brightness of the organic EL element. By determining the data signal voltage so that Vb is set as the black level voltage and Vw is set as the white level voltage, a suitable gray scale control can be achieved in the organic EL element.

Because a current when a pixel is driven with a certain data signal voltage depends on characteristics of the driver TFT 1, such as Vth and a slope (μ) of the V-I curve, the brightness would be uneven when the characteristics of the driver TFTs 1 in the panel such as Vth and μ vary among pixels. In order to correct the brightness unevenness, it is necessary to input, to each pixel, a data signal voltage such that the same brightness is achieved corresponding to the same image data signal. For this purpose, one or a number of predetermined pixels of a panel is caused to emit light at several signal levels, and the V-I curve of the TFT has been determined based on the panel current at each signal level (refer to, for example, U.S. Patent Application Publication No. 2004/0150592 and WO 2005/101360).

Currently, the current value for each pixel, although dependent on the efficiency of the organic EL element to be used and the pixel density, is few microamperes (μA) or less even when the organic EL element is caused to emit bright light at a typically used level, and in particular, a current of 1 μA or less must be measured in order to determine the variation in the current value near the black level. In this case, noise coming from the outside of the panel and noise flowing from the driver circuits in the panel to the CV and PVdd power supplies become factors that reduce the measurement precision.

SUMMARY OF THE INVENTION

According to one aspect of the present invention, there is provided a method of measuring a panel current in an active matrix organic electroluminescence display panel wherein, when a current flowing through a display panel when one or a plurality of pixels are caused to emit light is measured, a flow-in current flowing into the display panel from a side of a high voltage and a flow-out current flowing out from the display panel toward a side of a low voltage are simultaneously measured, and a value of a panel current is determined using both obtained measurement results.

According to another aspect of the present invention, it is preferable that, in the method of measuring a panel current, an adding process of the measurement result of the flow-in current and the measurement result of the flow-out current is performed when the value of the panel current is determined.

According to another aspect of the present invention, it is preferable that, in the method of measuring a panel current, the adding process of the measurement result of the flow-in current and the measurement result of the flow-out current is a weighted addition process.

According to another aspect of the present invention, there is provided a device which measures a panel current in an active matrix organic electroluminescence display panel, the device includes a flow-in current measurement unit which measures a flow-in current flowing into a display panel from a high-voltage power supply, a flow-out current measurement unit which measures a flow-out current flowing out from the display panel toward a low-voltage power supply, and an adder which adds a flow-in current and a flow-out current which are simultaneously measured, wherein a panel current is measured based on a result of addition obtained by the adder.

Because the flow-in current flowing into the display panel and the flow-out current flowing out of the display panel are added and the current through the pixel is measured, the influences of the noise can be reduced.

BRIEF DESCRIPTION OF THE DRAWINGS

Preferred embodiments of the present invention will be described in detail by reference to the drawings, wherein.

DESCRIPTION OF THE PREFERRED EMBODIMENT

Figure 1:
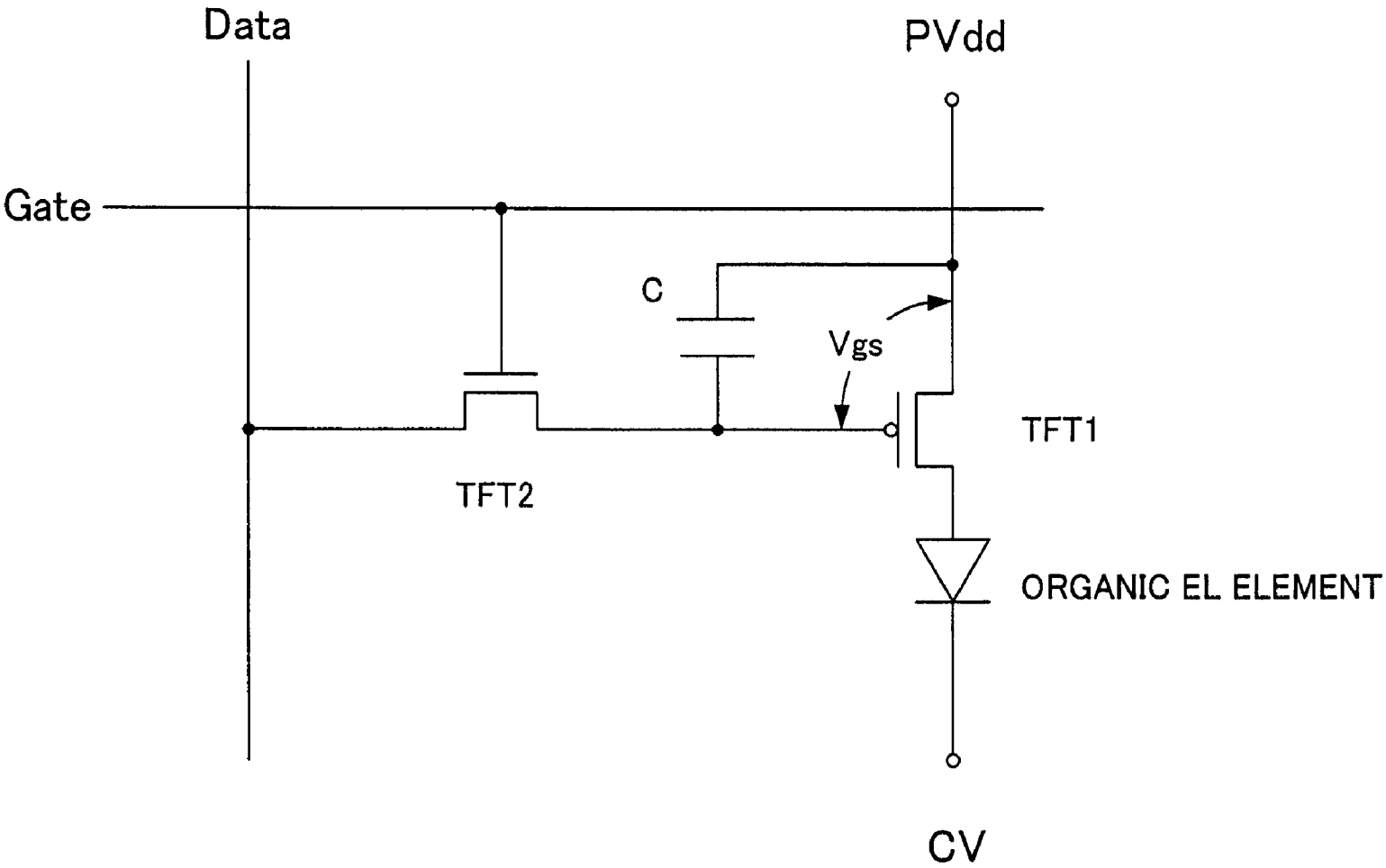
Fig. 1 PRIOR ART
FIG. 1 is a diagram showing a prior art structure of a pixel circuit.
Figure 2:
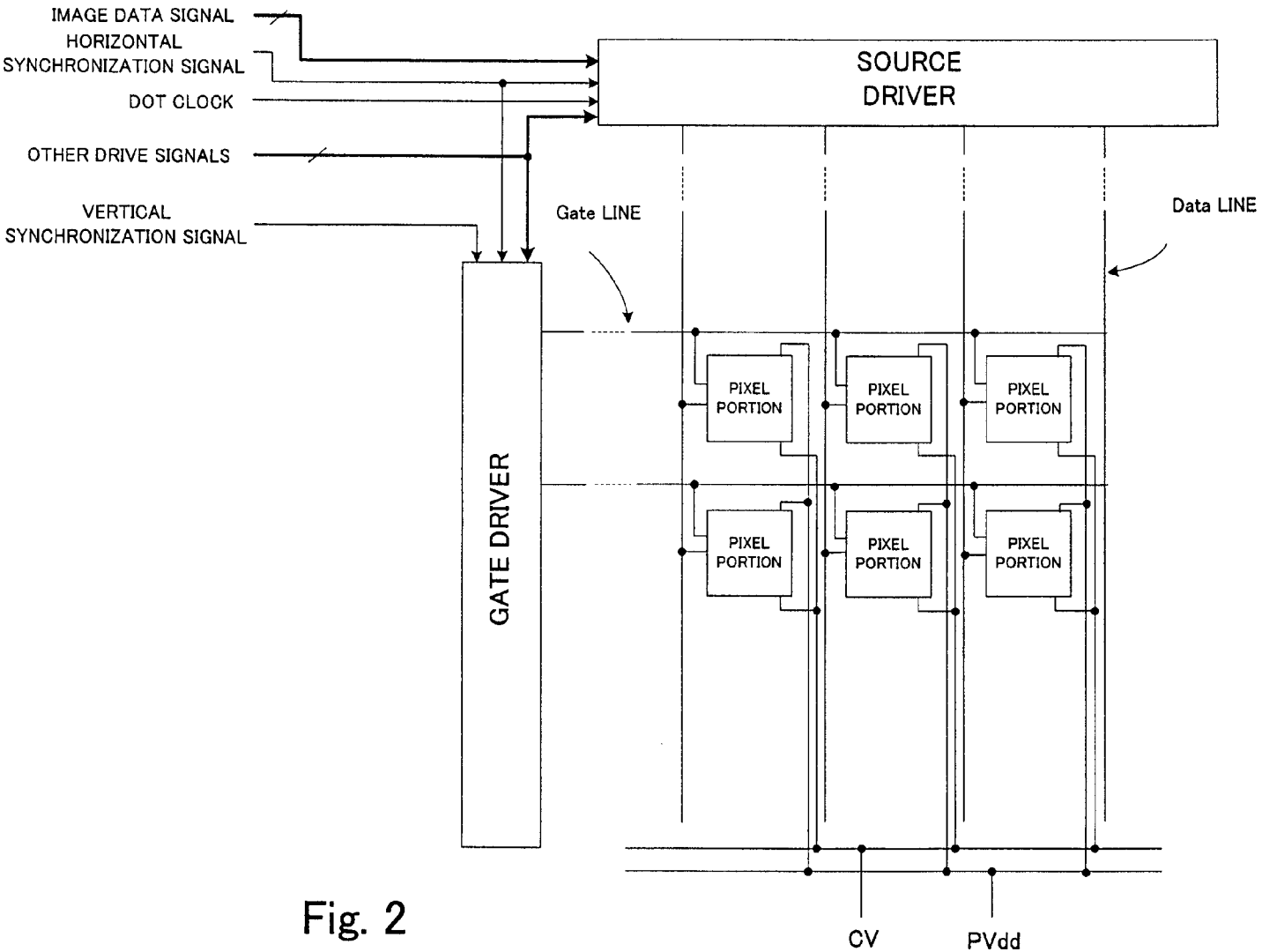
Fig. 2 PRIOR ART
FIG. 2 is a diagram showing a prior art structure of a display panel.
Figure 3:
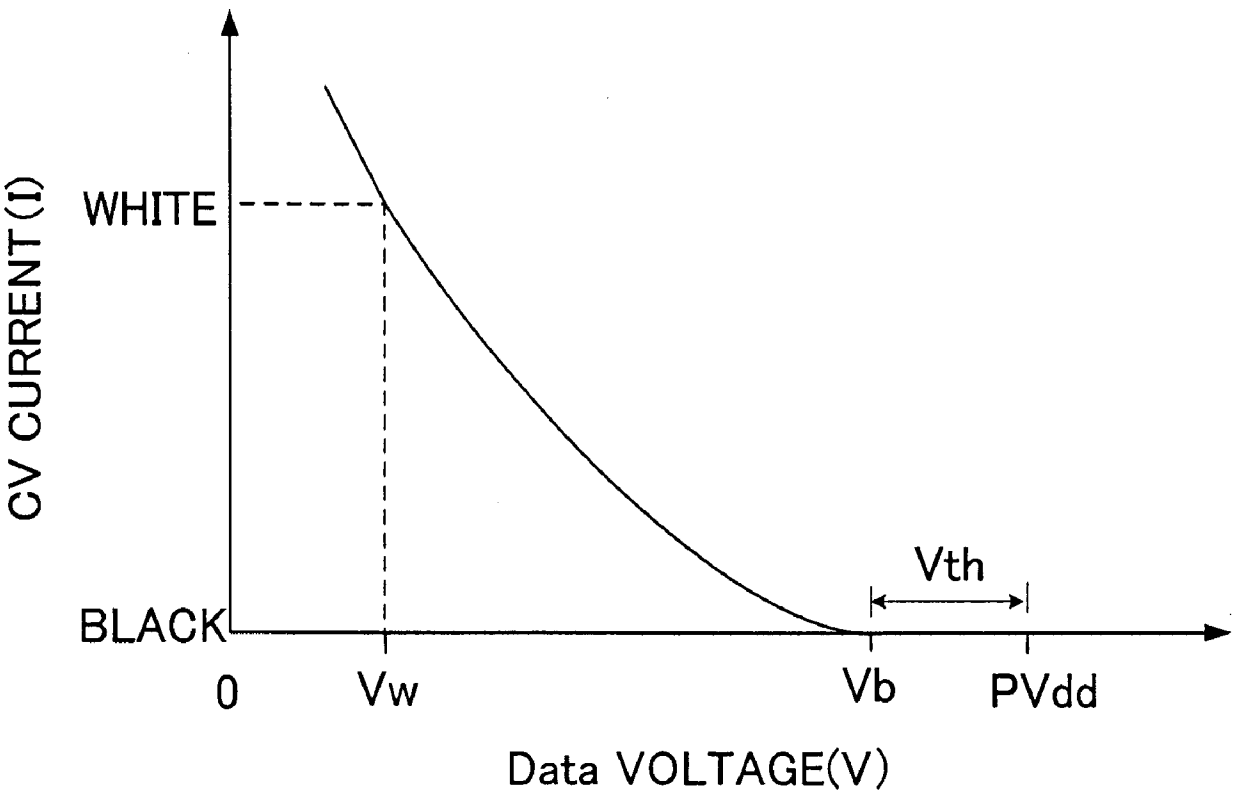
Fig. 3 PRIOR ART
FIG. 3 is a diagram showing a prior art relationship between a data voltage and a CV current.

A preferred embodiment of the present invention will now be described referring to the drawings.

Explanation of the Principle

Figure 4:
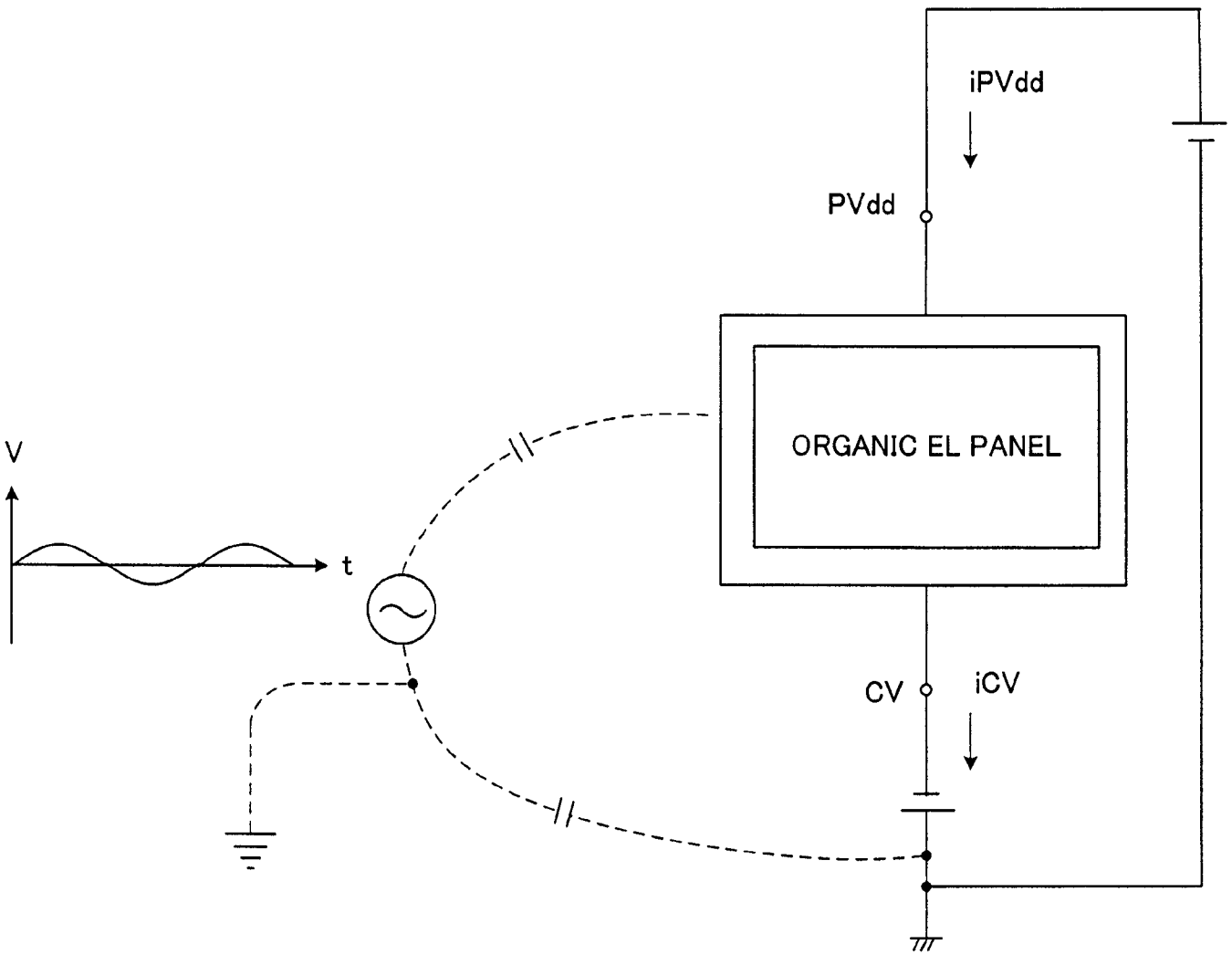
FIG. 4 is a diagram for explaining a situation in which noise is introduced into the display panel.
Figure 5:
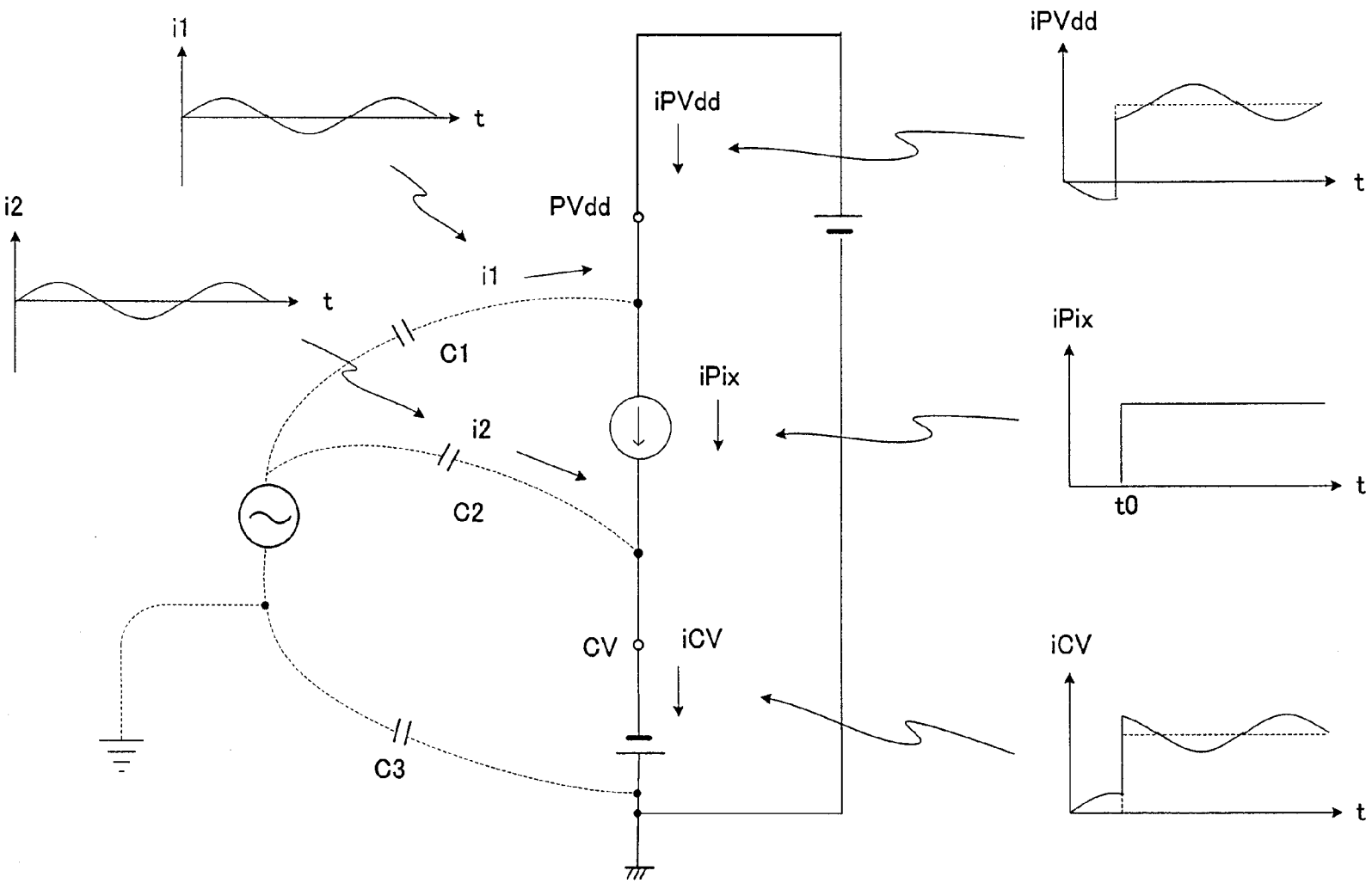
FIG. 5 is a diagram for explaining a situation of noise from outside.
Figure 6:
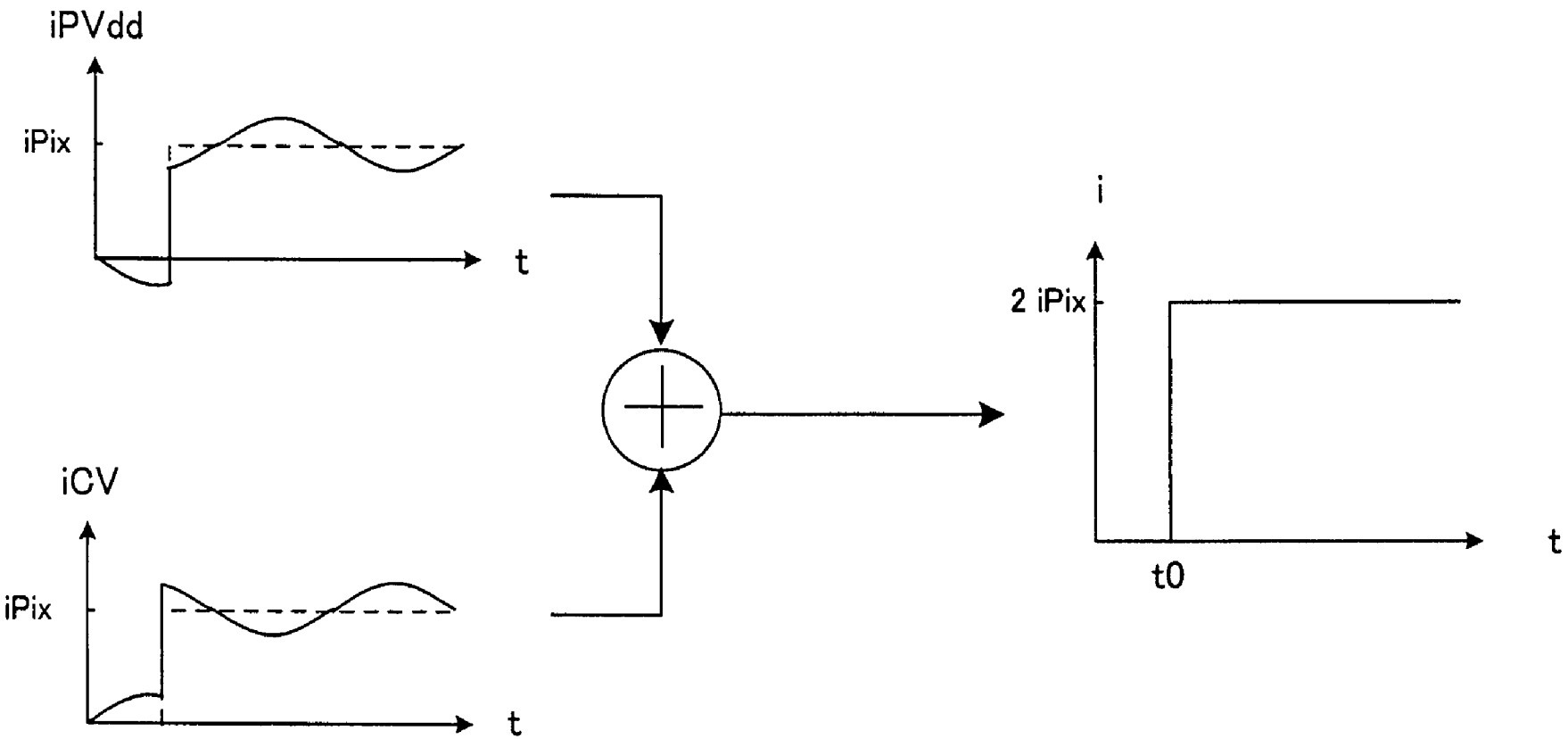
FIG. 6 is a diagram for explaining addition of two currents iPVdd and iCV.

FIG. 4 is a diagram showing how noise of hum of a commercial power supply or the like is introduced from outside. Because the PVdd power supply lines and cathodes of the organic EL elements are placed over the entire surface of the panel, noise from the outside tends to be introduced into these structures, and the noise is superposed on each current in the panel, as shown in FIG. 5. First, because the current flowing through the organic EL element is determined by the gate voltage of the driver TFT 1, basically, the current does not depend on the power supply voltage. Therefore, as shown in FIG. 5, as the current iPix for one pixel, a current corresponding to the data signal flows from the emission start time t0. On the other hand, similar noise i1 and i2 from the commercial power supply are introduced into PVdd and CV, which appear in reversed phases on the PVdd line and the CV line. Thus, as shown in FIG. 6, by adding iPVdd and iCV, the noise is cancelled, and a value of 2iPix is obtained.

Figure 7:
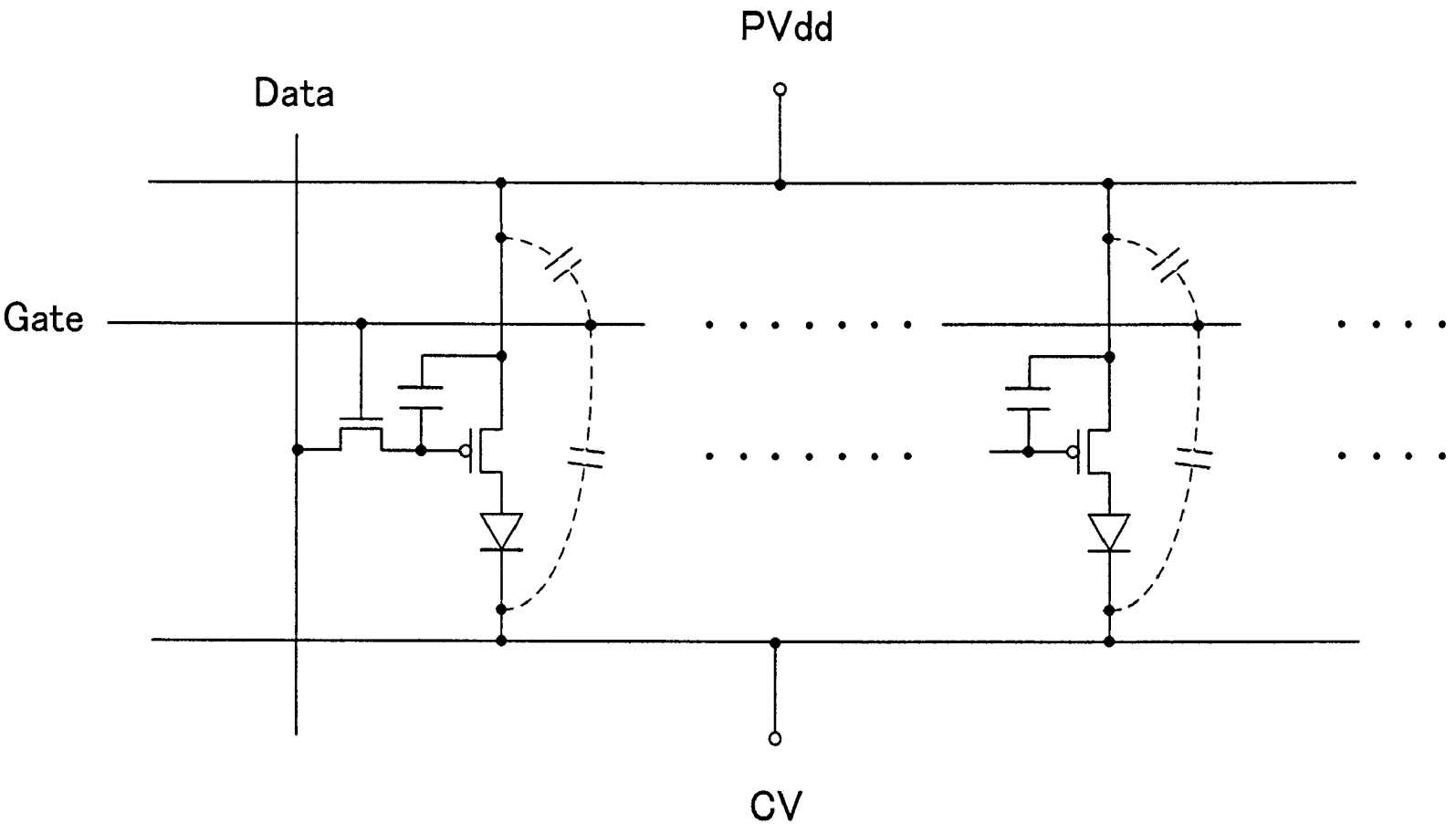
FIG. 7 is a diagram for explaining a floating capacitor of an internal circuit.

There is another problem in that the noise of a drive signal used inside the panel is superposed on the pixel current. For example, as shown in FIG. 7, a floating capacitor (capacitance) is present between the Gate line and PVdd and between the Gate line and CV, and a waveform of a derivative of the Gate signal which is a voltage source appears on the PVdd line and CV line through the floating capacitors. The noise component becomes a factor reducing the S/N ratio (signal-to-noise ratio) when a very small current such as a pixel current is to be measured.

Figure 8:
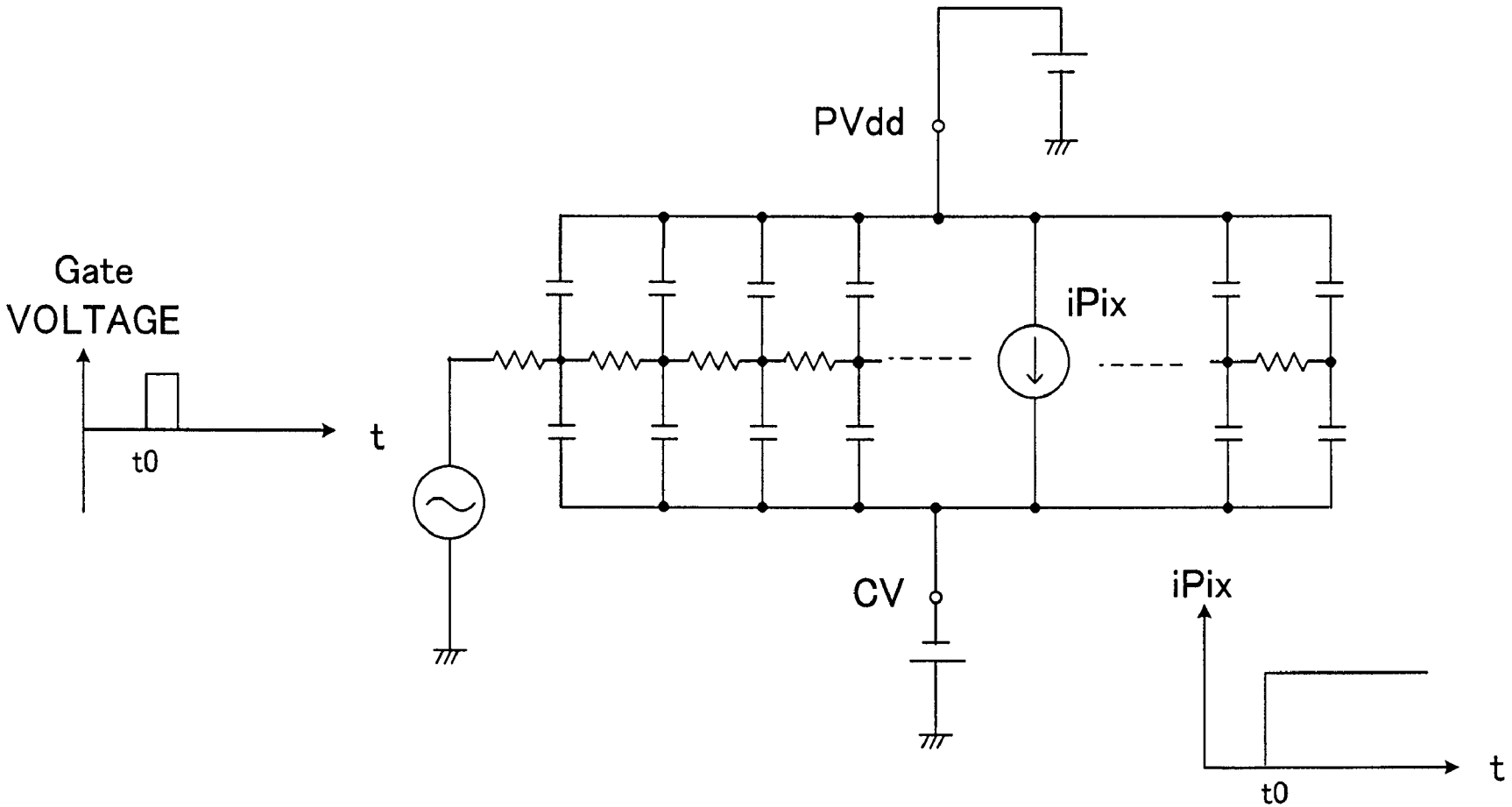
FIG. 8 is a diagram showing an equivalent circuit of a display panel when a current is applied through a pixel.
Figure 9:
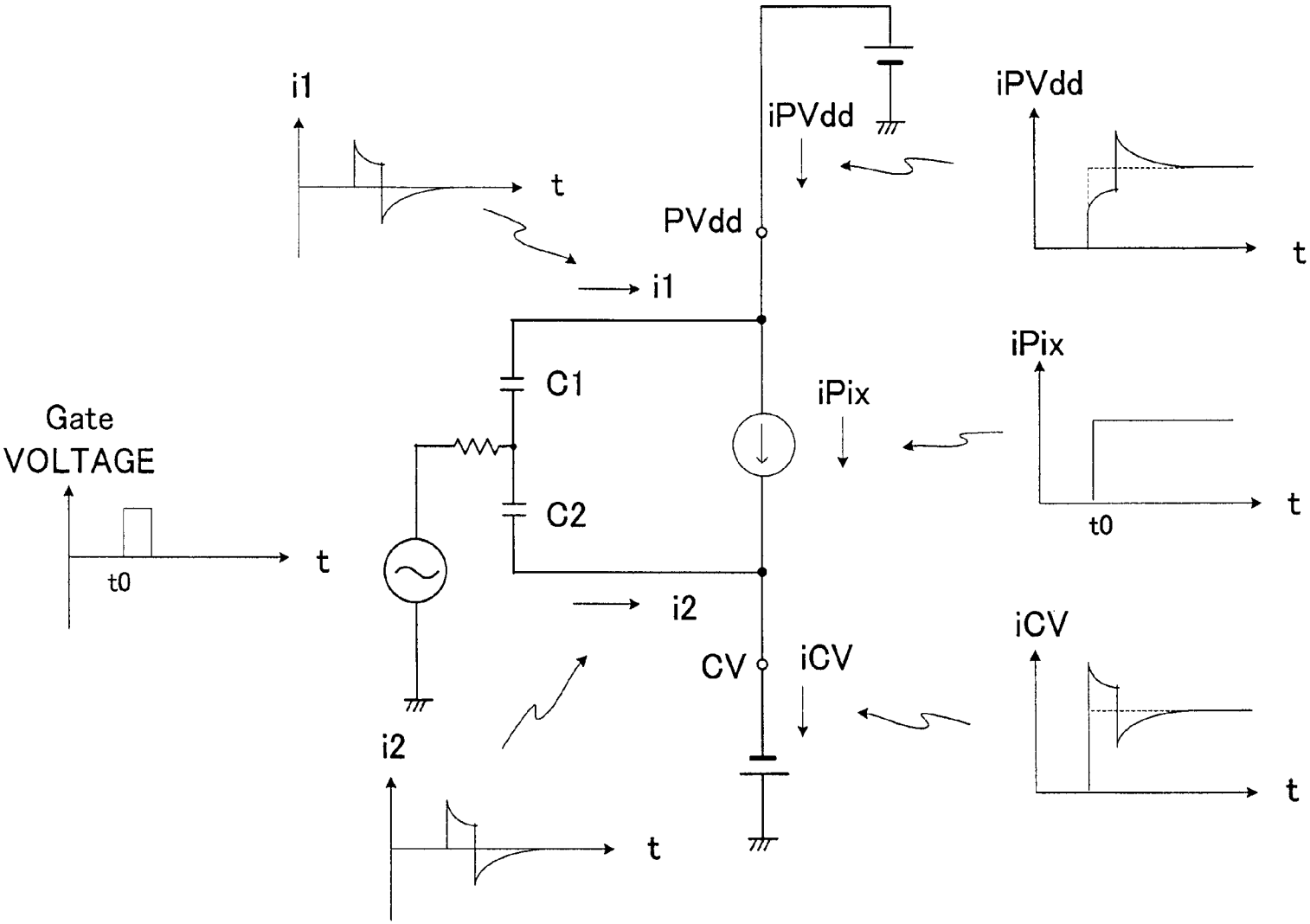
FIG. 9 is a diagram for explaining a situation of noise from an internal circuit.
Figure 10:
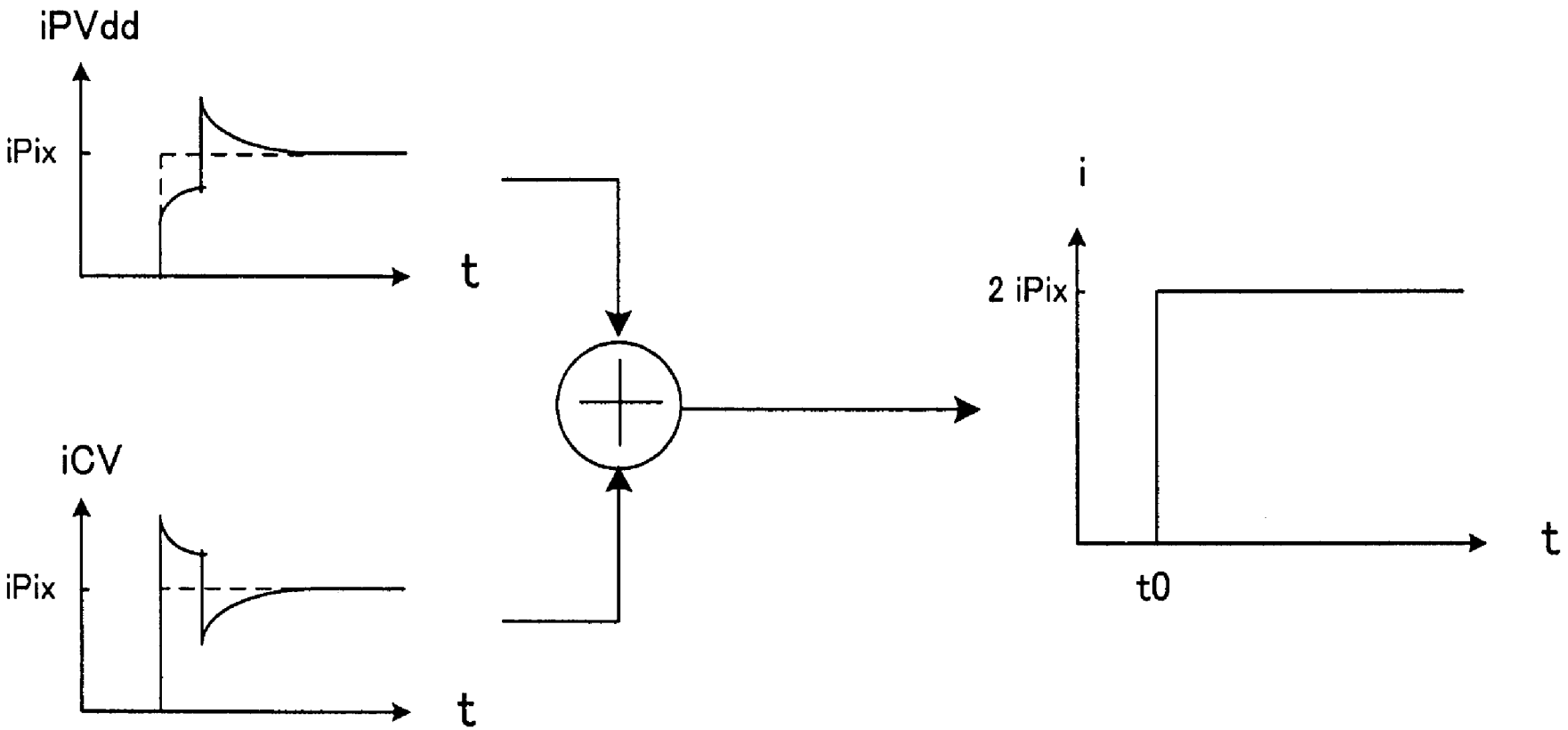
FIG. 10 is a diagram for explaining addition of two currents iPVdd and iCV.

FIG. 8 shows an equivalent circuit regarding the horizontal line on which an emitting pixel is present when the resistance component of the Gate line and the above-described floating capacitor are considered. FIG. 9 shows a simplified version of the equivalent circuit. As shown in FIG. 8, a derivative component of the Gate signal appears on the PVdd and CV lines in reversed phases. Therefore, in this case also, as shown in FIG. 10, by adding iPVdd and iCV, the noise can be cancelled and a value of 2iPix can be obtained.

As described, the noise superposed on the PVdd current and CV current is in reversed phases regardless of whether the noise generating factor is inside or outside. Therefore, as shown in FIGS. 6 and 10, by adding the measured values of the CV current measurement value iCV and PVdd current iPVdd, the noise can be reduced, and thus, by determining a pixel current using an addition result of iCV and iPVdd, the influences of noise can be reduced, the current can be more reliably measured, and brightness unevenness occurring among the display elements can be precisely known.

When the noise current components appearing on the CV terminal and the PVdd terminal are set as a×N and b×N, respectively, where a and b are constants, currents iCV and iPVdd can be represented by:

$$iCV = iPix - a \times N$$

$$iPVdd = iPix + b \times N$$

Thus, in order to cancel the noise component, the following calculation can be performed:

$$b \times iCV + a \times iPVdd = b \times iPix - ab \times N + a \times iPix + ab \times N$$

$$= (a + b) \times iPix$$

The optimum values for the constants a and b depend on the resistance component of the line inside the panel, the floating capacitor, a configuration of the PVdd line and the cathode, noise component for which the noise reduction is most strongly desired, etc.

FIGS. 6 and 10 show a case in which C1=C2 in FIGS. 5 and 9, and constants a and b are set so that a=b. In reality, however, C1≠C2, and the derivative waveforms of the noise would differ from each other. Thus, the noise cannot be completely cancelled with a simple addition calculation, but can be reduced. Moreover, a similar noise reduction advantage can be obtained also in a case where independent, random noise is superposed on iCV and iPVdd. For example, when iCV and iPVdd are added in a ratio of 1:1, the iPix component would be doubled while the noise component is multiplied by $\sqrt{2}$, and thus the S/N ratio is theoretically improved by 3 dB.

It is also possible to detect constants a and b by, for example, forcefully applying noise. When the values for constants a and b are determined, it is preferable to apply a weighted addition to determine (a+b)×iPix.

Figure 11:
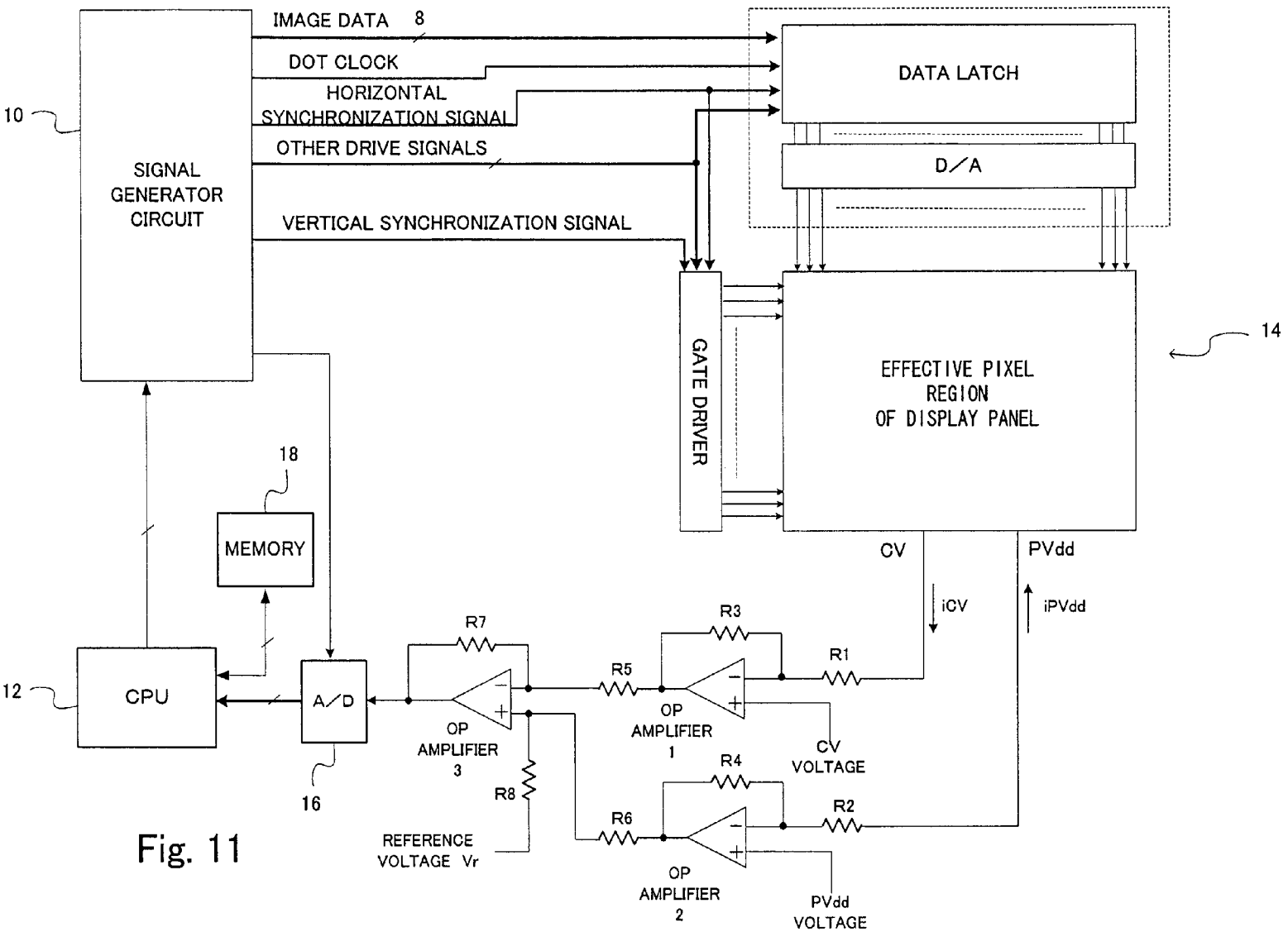
FIG. 11 is a diagram showing a structure of a measurement circuit according to a preferred embodiment of the present invention.

FIG. 11 shows an example pixel current measurement circuit having a circuit which adds the CV current measurement value and the PVdd current measurement value.

A signal generator circuit 10 generates image data and a control signal for causing the pixels to emit light, pixel by pixel, and measuring current, according to an instruction by a CPU 12. A CV terminal of a panel 14 is connected to a negative input terminal of an operational amplifier (OP amplifier) OP1 via a resistor R1. Because a CV voltage is input on a positive input terminal of the operational amplifier OP1 and an output is negatively fed back via a resistor R3, a voltage of (CV voltage−iCV×R3) is output on the output terminal of the operational amplifier OP1. A PVdd terminal of the panel 14 is connected to a negative input terminal of an operational amplifier OP2 via a resistor R2. Because the PVdd voltage is input on a positive input terminal of the operational amplifier OP2 and an output is negatively fed back via a resistor R4, a voltage of (PVdd voltage+iPVdd× R4) is output on an output terminal of the operational amplifier OP2.

The resistors R1 and R2 may be omitted, but by inserting these resisters R1 and R2, the gain of the circuit for the noise which is a voltage supply can be reduced while not affecting the direct current gain for the pixel current iPix. However, care must be taken as larger resistances of the resisters result in slower responses of output corresponding to iPix due to influences of capacitors within the panel (such as C1 and C2 in FIG. 9). In addition, with these resistors, because the voltages on the CV and PVdd terminals of the panel become (CV voltage+iCV×R1) and (PVdd voltage−PVdd×R2), respectively, the resistance values must be determined in a range in which these voltage change would not affect the measurement result.

The output terminals of the operational amplifiers OP1 and OP2 are connected to negative and positive input terminals of an operational amplifier OP3 via resistors R5 and R6, respectively. Therefore, the outputs of the operational amplifiers OP1 and OP2 are differentially amplified by the operational amplifier OP3, and a voltage represented by the following formula (Vadin) is obtained and is input to an A/D converter 16.

[Formula 1]

$$Vadin=\{(PVdd\ \text{voltage}+iPVdd\cdot R4)\cdot R8-Vr\cdot R6\}\cdot(R5+R7)/R5\cdot(R6+R8)-R7\cdot(CV\ \text{voltage}-iCV\cdot R3)/R5$$

The operational amplifier OP3 is negatively fed back via a resistor R7, and a reference voltage Vr is supplied to the positive input terminal of the operational amplifier OP3 via a resistor R8. The reference voltage Vr is set so as to achieve an optimum offset value to be input to an A/D converter at the downstream.

When R5 is set equal to R6 (R5=R6) and R7 is set equal to R8 (R7=R8), a voltage proportional to a difference between outputs of the operational amplifiers OP1 and OP2 is output at the output of the operational amplifier OP3, and thus Vadin becomes a voltage in which a DC offset of {(PVdd−CV)·R7/R5−Vr} is added to a weighted sum of iCV and iPVdd in a ratio of (R3:R4).

In other words, by setting the reference voltage Vr at an appropriate value, it is possible to set the DC offset value of the voltage input to the A/D converter 16 to a suitable voltage (for example, 0V), and a code corresponding to a voltage of (R3×iCV+R4×iPVdd)R7/R5 is obtained from the A/D converter 16. By setting the values of resistances R3 and R4 according to a ratio of the two instances of noise, the noise can be removed and a code corresponding to a voltage which is (R3+R4)R7/R5 times that of the drive current can be obtained.

The pixels are caused to emit light one by one, an amount of current for each pixel is detected, and a detected value or a compensation value based on the detected value is stored in a memory 18. During the actual display, the data signal to be supplied to each pixel is corrected based on the value stored in the memory 18 so that the variation among the pixels is compensated and suitable display is realized.

PARTS LIST

| Parts List | |
|---|---|
| 1 | TFT driver |
| 2 | selection TFT |
| 10 | generator circuit |
| 12 | CPU |
| 14 | panel |
| 16 | A/D converter |
| 18 | memory |

The invention claimed is:

1. A method of measuring a panel current in an active matrix organic electroluminescence display panel comprising steps of:

measuring a current flowing through a display panel when one or a plurality of pixels are caused to emit light;

measuring simultaneously a flow-in current flowing into the display panel from a side of a high voltage and a flow-out current flowing out from the display panel toward a side of a low voltage;

determining a value of a panel current using both obtained measurement results; and performing an adding process of the measurement result of the flow-in current and the measurement result of the flow-out current, and canceling noise components in the flow-in current and the flow-out current when the value of the panel current is determined.

2. A method of measuring a panel current according to claim 1, wherein:

the adding process of the measurement result of the flow-in current and the measurement result of the flow-out current is a weighted addition process.

3. A device which measures a panel current in an active matrix organic electroluminescence display panel, the device comprising:

a flow-in current measurement unit which measures a flow-in current flowing into a display panel from a high-voltage power supply;

a flow-out current measurement unit which measures a flow-out current flowing out from the display panel toward a low-voltage power supply; and an adder which adds a flow-in current and a flow-out current which are simultaneously measured, and cancels noise components in the flow-in current and the flow-out current, wherein:

a panel current is measured based on a result of addition obtained by the adder.

* * * * *